United States Patent [19]

Barari

[11] Patent Number: 4,522,000

[45] Date of Patent: Jun. 11, 1985

[54] EARTHQUAKE SAFETY SUPPORT FOR TRANSPORTABLE BUILDING

[76] Inventor: Fred S. Barari, 1941 Hamilton Ave., San Jose, Calif. 95125

[21] Appl. No.: 372,974

[22] Filed: Apr. 29, 1982

Related U.S. Application Data

[63] Continuation-in-part of Ser. No. 259,867, May 4, 1981, abandoned.

[51] Int. Cl.[3] ..... E02D 27/34

[52] U.S. Cl. ..... 52/167; 248/228; 248/231.7

[58] Field of Search ..... 52/167, DIG. 11; 248/72, 228, 231.6, 352, 357, 421, 226.4, 225.3 R, 231.7, 226.3; 24/335, 514, 522

[56] References Cited

U.S. PATENT DOCUMENTS

| | | | |
|---|---|---|---|
| 1,592,814 | 2/1926 | Harris | 248/228 X |
| 1,652,695 | 12/1927 | Barber | 248/72 |
| 1,746,027 | 2/1930 | Cannon | 248/357 X |
| 1,768,543 | 7/1930 | Clausing | 248/228 |
| 2,048,449 | 7/1936 | Holtzmann | 248/225.31 |
| 2,979,304 | 4/1961 | Teel | 248/354.3 |
| 3,218,811 | 11/1965 | Barall et al. | 248/357 X |
| 3,268,946 | 8/1966 | Case | 24/335 |
| 3,317,188 | 5/1967 | Linscott et al. | 248/357 X |
| 3,747,951 | 7/1973 | Brown | 248/352 X |
| 3,750,349 | 8/1973 | Deike | 52/DIG. 11 X |
| 3,782,673 | 1/1974 | Wehrens | 248/357 |
| 3,830,024 | 8/1974 | Warnke | 52/23 |
| 4,014,517 | 3/1977 | Keagle | 254/45 |
| 4,064,668 | 12/1977 | Carter | 248/352 |
| 4,138,806 | 2/1979 | Miller | 52/DIG. 11 |
| 4,148,162 | 4/1979 | Goodrich | 52/23 |
| 4,214,410 | 7/1980 | Mitsueda | 248/352 X |
| 4,261,149 | 4/1981 | Gustafson | 52/DIG. 11 X |
| 4,353,519 | 10/1982 | Bogart | 248/228 |
| 4,407,479 | 10/1983 | Combe | 411/389 |
| 4,417,426 | 11/1983 | Meng | 52/167 |

FOREIGN PATENT DOCUMENTS

| | | | |
|---|---|---|---|
| 476322 | 4/1929 | Fed. Rep. of Germany | 248/228 |

*Primary Examiner*—John E. Murtagh
*Assistant Examiner*—Andrew Joseph Rudy
*Attorney, Agent, or Firm*—Allston L. Jones

[57] ABSTRACT

A stabilizing support for mobile homes and other transportable buildings is disclosed which protects against damage caused by the building slipping off its piers in an earthquake. A base on the ground underneath the building is connected to the building frame by support arms amd a stabilizer arm. In one embodiment, the support arms are connected in the form of an X. In another embodiment, two structures are connected via the stabilizer arms. Several embodiments may be constructed from the same basic components, and adjustment can be made for the varying height of buildings. Also included is a clamp utilizing two crescent shaped jaw members coupled one to the other by means of a doubly threaded bolt which passes through holes in the two crescent shaped jaw members and spans the items being clamped. Completing the clamp is a pair of nuts which are threaded onto opposite ends of the bolt and tightened to complete the clamping action.

6 Claims, 14 Drawing Figures

EARTHQUAKE SAFETY SUPPORT FOR TRANSPORTABLE BUILDING

CROSS REFERENCE TO RELATED APPLICATION

This is a continuation-in-part of a co-pending application bearing Ser. No. 259,867 now abandoned and filed on May 4, 1981, by the applicant.

BACKGROUND OF THE INVENTION

Transportable buildings such as mobile homes are typically built upon a frame containing two or more longitudinal members and several transverse beams. This frame serves as both a support for the flooring of the building, and as a mounting base for wheel axles and towing couplers while the building is being transported. Although the frame may be designed with considerable strength to endure the loads on the structure encountered while the building is in transit, the frame design usually lacks any provision for stable, secure placement of the building when a destination is reached.

Most commonly, a mobile home is positioned on a site be towing the home into place, jacking it up off its wheels, and placing a number of piers under the frame. When the jacks are removed, the piers bear the weight of the mobile home, which sits elevated above the ground. Mobile home piers are generally pyramidal or conical in shape, and may be made of bricks, steel, or concrete. While the piers may have provisions for leveling the mobile home and equally distributing the weight among the set of piers, there is typically no secure attachment of the mobile home frame to the piers. Hence, only the weight of the mobile home, pressing down through the frame onto the piers, keeps the mobile home in place.

Under ordinary circumstances, a mobile home may rest on its piers with apparent security, because no lateral forces are present to displace the structure. However, significant lateral forces may arise from natural events such as severe windstorms, or more importantly, earthquakes. The lateral forces developed in an earthquake may cause the mobile home to shift off the piers and crash to the ground, injuring persons and property. The piers themselves may cause significant damage by piercing through the flooring of the building when the frame shifts laterally.

SUMMARY OF THE INVENTION

In accordance with the preferred embodiments of the present invention, a stabilizing support for transportable building slipping off the normally unattached pier supports. In one preferred embodiment, a pair of diagonal support arms connect the frame of a transportable building to a base on the ground, while a stabilizing arm connects the support structure to a third point on the frame. Two such support structures may be connected together by crossing their stabilizing arms and connecting them. In another embodiment, the support arms are connected in an X-shape. High strength is achieved by using lengths of angle steel for the arms, while variations in height of buildings can be accommodated by adjusting the angle of the support arms. Several embodiments may be constructed using the same basic components, offering adaptability and simplicity in manufacturing.

DESCRIPTION OF THE PREFERRED EMBODIMENTS

Figure 1:
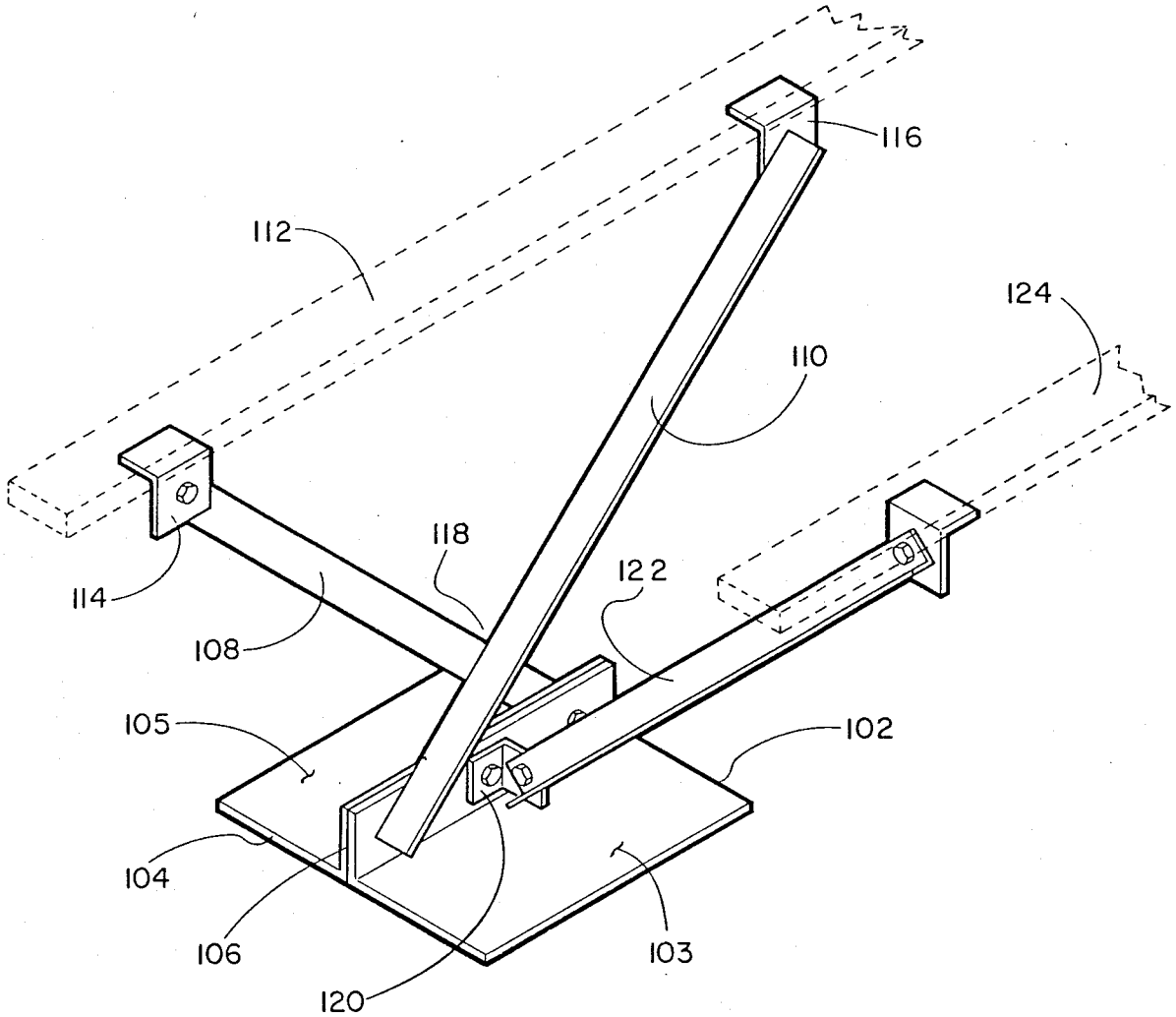
FIG. 1 shows a stabilizing support having crossed support arms.

Referring now to FIG. 1, a base 102 is positioned on the ground underneath a transportable building. For exemplary purposes, the transportable building may be taken to be a mobile home, although similar structures used for other purposes will also benefit from the present invention. In the preferred embodiment, base 102 is easily formed by bolting together two flanged metal plates 103 and 105 to produce a horizontal surface 104 and a vertical flange 106.

A pair of support arms 108 and 110, preferably of $2'' \times 3'' \times \frac{1}{4}''$ angle steel, connect base 102 to a mobile home frame member 112. Brackets 114 and 116 provide surfaces for bolting or clamping support arms 108 and 110 to frame member 112. The lower ends of support arms may be bolted at 118 into a shape resembling the letter "X". Support arms 108 and 110 are preferably of a single-piece construction and equal length to produce a symmetrical X-shape, and lie in a vertical plane.

A bracket 120, bolted to flange 106, connects a stabilizer arm 122 to base 102. Stabilizer arm 122 may be constructed of the same material as support arms 108 and 110, but must be of proper length to reach frame member 124. If frame members are not conveniently located, additional members may be added to the frame to provide suitable attaching points. Stabilizer arm 122 lies in a plane orthogonal to the plane of the ground and to the vertical plane of the support arms.

Figure 2A:
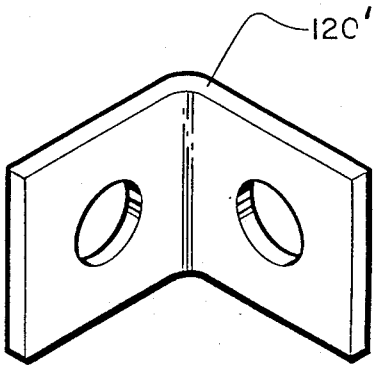
FIGS. 2*a* and 2*b* show two configurations for the bracket for attaching the stabilizer arm to the base.
Figure 2B:
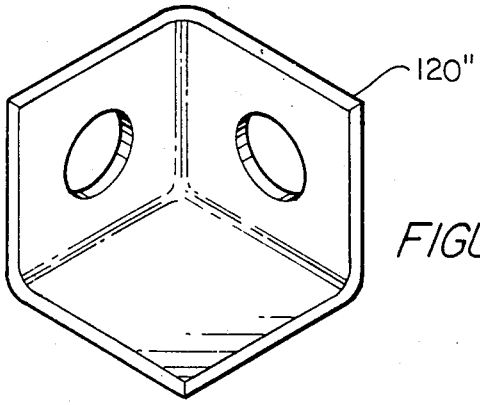
Figure 6A:
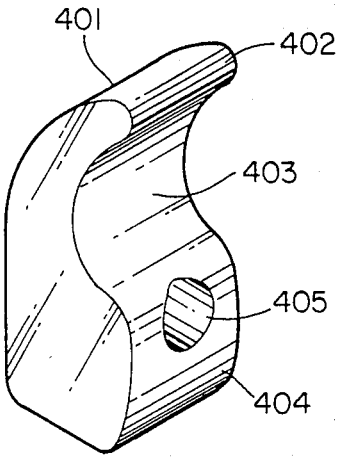
FIG. 6*a* and 6*b* each shows an isometric view of the clamps of the present invention.
Figure 6B:
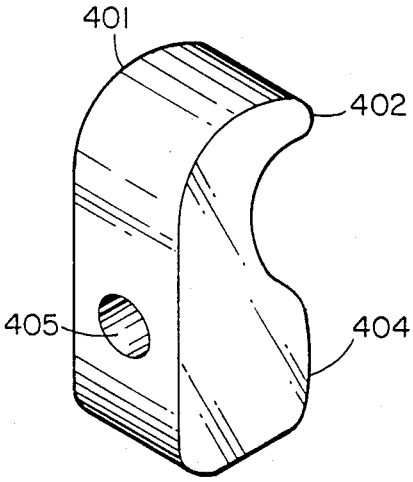

FIGS. 2*a* and 2*b* show more clearly two configurations (brackets 120' and 120'', respectively). for bracket 120 of FIG. 1 which interconnects stabilizer arm 122 and flange 106.

Figure 3:
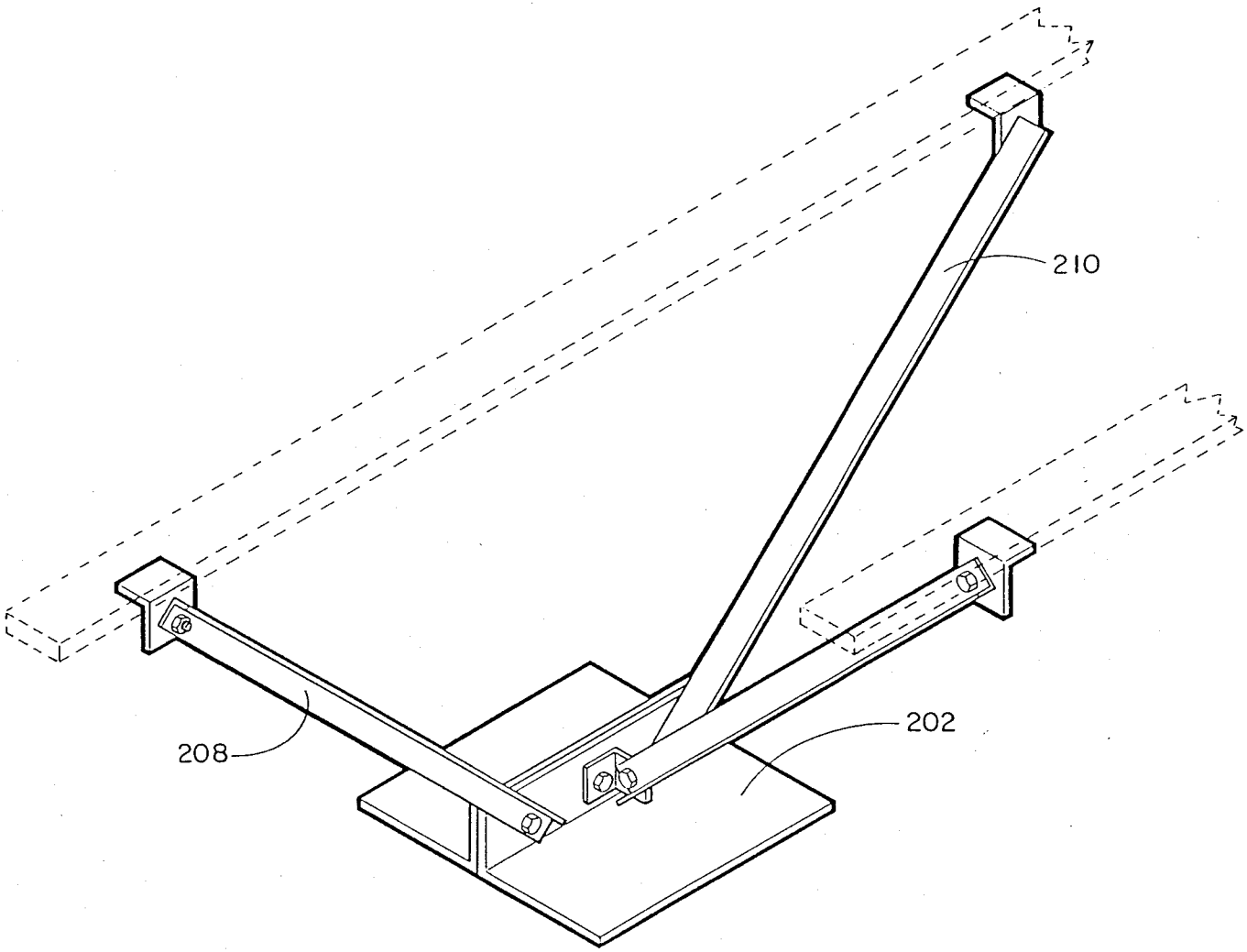
FIG. 3 shows a stabilizing support having uncrossed support arms.

Referring now to FIG. 3, another embodiment employs a pair of support arms 208 and 210 which spread outward from base 202 without crossing. The embodiment of FIG. 3 may be constructed using the same components as the embodiment of FIG. 1 by changing the placement of the support arms. Equal length support arms and 45° placement with respect to the horizontal are preferred for this embodiment.

Figure 4:
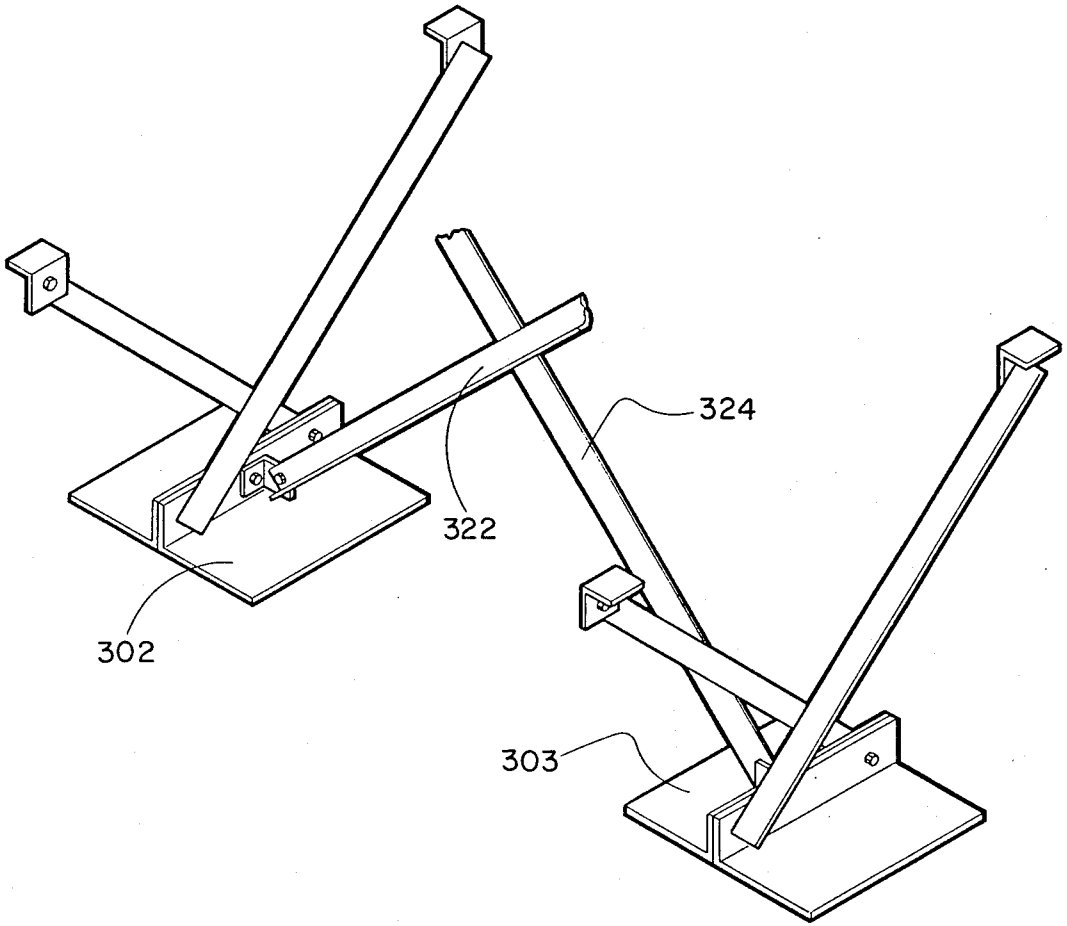
FIG. 4 shows a stabilizing support having two structures with connected stabilizing arms.

Referring now to FIG. 4, another embodiment uses two of the basic structures of FIG. 1. Stabilizing arms 322 and 324 are crossed and connected in a fashion analogous to the positioning of the support arms, thus linking base 302 to base 303. Further, the upper end of each of stabilizer arms 322 and 324 may be connected to the same frame member as the support arms of the adjacent support structure or any other convenient frame member.

Figure 5:
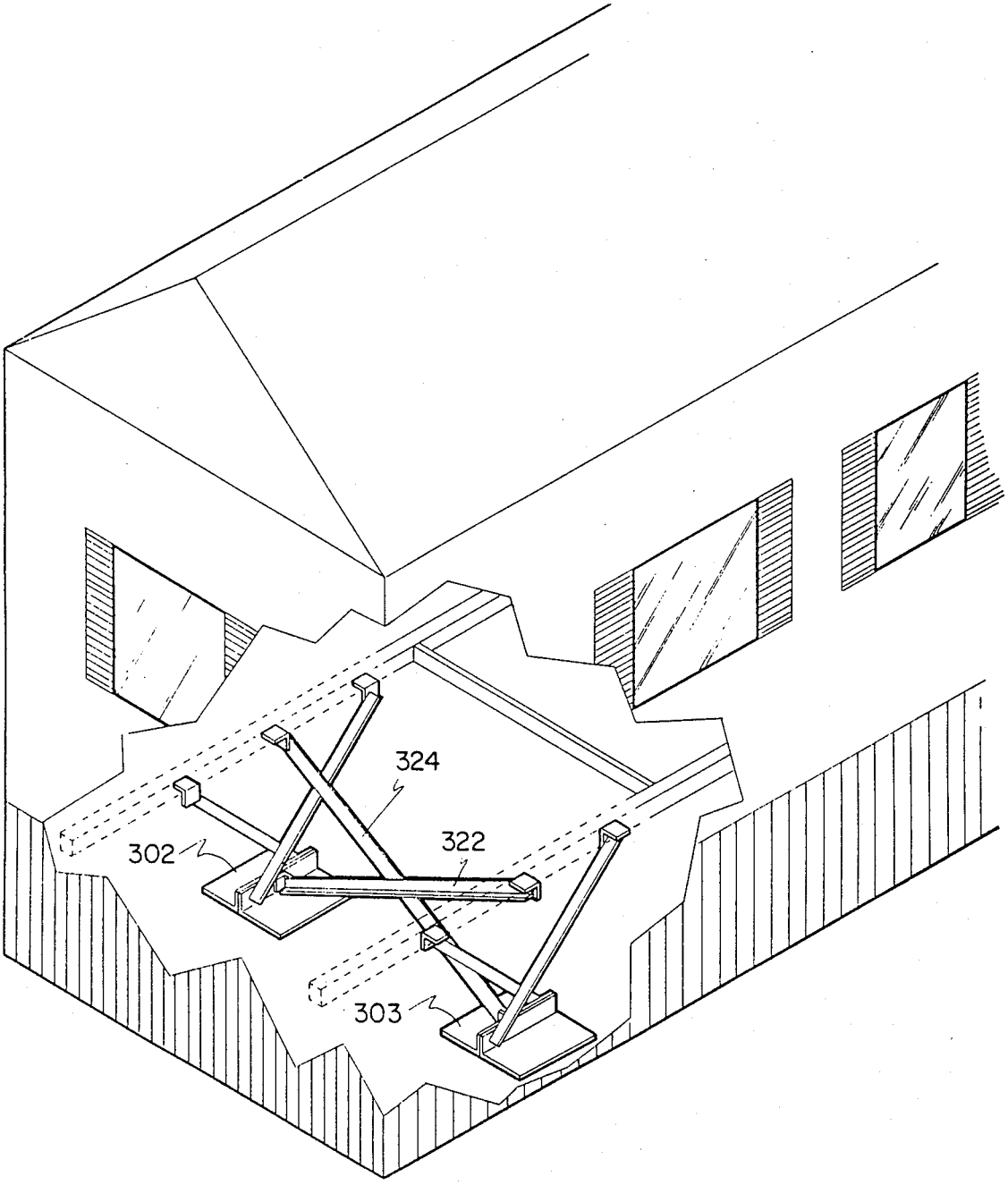
FIG. 5 shows a cut-away view of a mobile home with the dual stabilizing support of FIG. 4 in place.

In FIG. 5, the configuration of FIG. 4 is shown, in a cut-away view, in place under a mobile home. This dual-stabilizer application could just as well be accomplished with a pair of the units shown in FIG. 3. Here the upper ends of stabilizer arms 322 and 324 are shown being connected to the same frame member at the same point as one of the support arms of the adjacent support structure.

In some applications it is impossible or undesirable to drill holes in mobile home frame members 112 and 124 to attach the support and stabilizer arms. FIGS. 6 through 11 show another embodiment which utilizes specially designed clamps and brackets to attach the support and stabilizer arms to the mobile home frame members.

Figure 8:
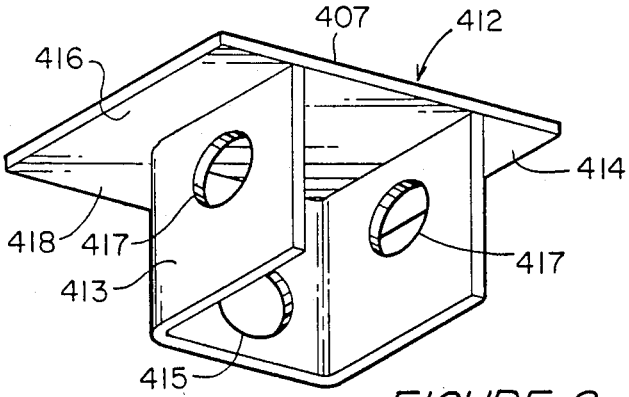
FIG. 8 is an isometric view of a second type of support arm bracket of the present invention.

FIG. 8 shows a bracket 412 including a U-channel portion 413 and a top plate 407. Top plate 407 is fastened to one end of the U-channel portion 413 substantially perpendicular to each of the sides thereof, and extends beyond all three sides of the U-channel portion 413 forming flanges 414, 416 and 418. U-channel 413 incorporates three holes. Holes 417 directly opposite each other in the parallel side portions and hole 415 in the third side substantially equidistant from the two parallel sides.

Bracket 412, in the clamped configuration, would then be bolted to the ends of support arms 108 and 110 of FIG. 1 or 208 and 210 of FIG. 3 with top plate 407 beneath mobile home support frame 112 with the shortest dimension of top plate 407 being approximately the same as the width of frame 112.

Figure 10:
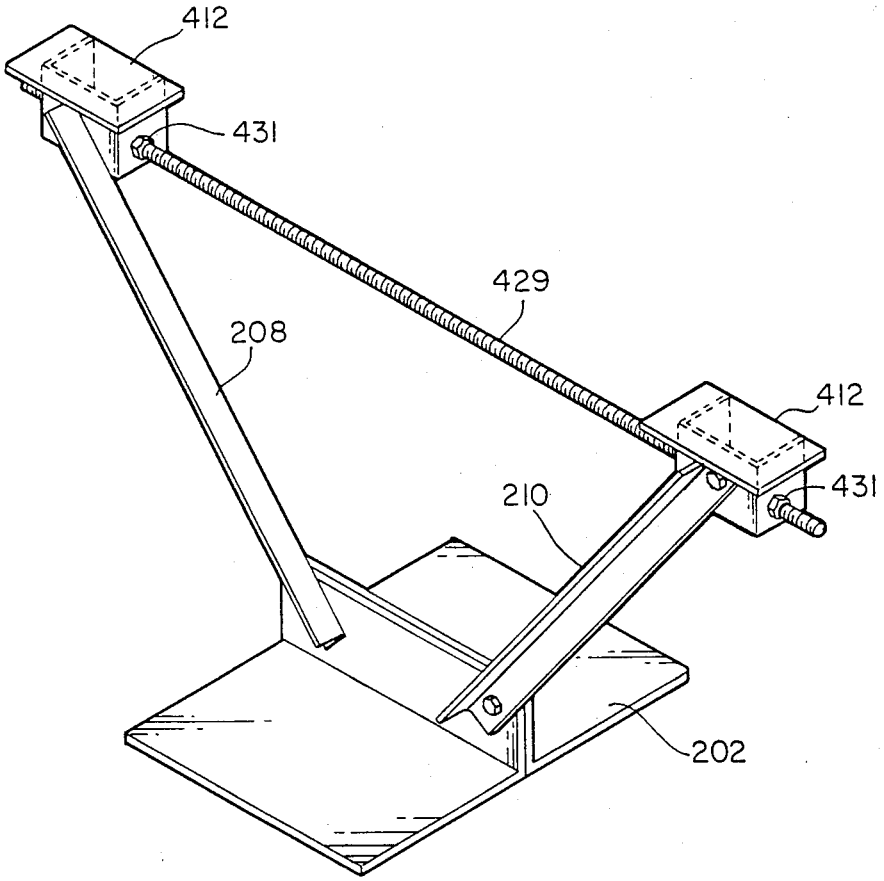
FIG. 10 is an isometric view of the support device of the present invention as shown in FIG. 3 incorporating the arm brackets of FIG. 8.

FIG. 10 shows brackets 412 in use on a support structure of the configuration shown in FIG. 3. Since brackets 412 will be clamped to mobile home support frame 112 by top flanges 414, 416 and 418 by clamps 401, it is possible that support arms 208 and 210, bolted to brackets 412, through holes 415, could rotate counter-clockwise and clockwise, respectively, if the clamps were to slip, rod 429 is connected between the two brackets 412 to maintain the correct spacing between them. This is done by having the ends of rod 429 threaded with the threaded ends pasing through holes 417 in each of brackets 412. Rod 429 is then bolted in position with nuts 431 on either side of the two parallel sides of the U-channel portion of bracket 412. This approach can also be included in the configuration shown in FIG. 1.

Figure 9:
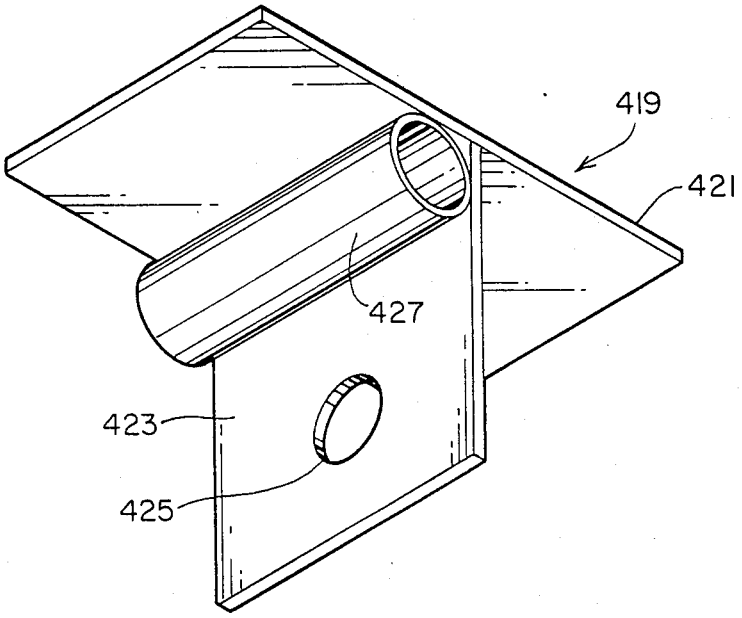
FIG. 9 is an isometric view of a second stabilizer arm bracket of the present invention.

FIG. 9 shows a bracket 419 for use on the end of stabilizer arm 122 for fastening it to mobile home frame member 124. Bracket 419 is a tee bracket having a top plate 421 to which is welded plate 423 to form the tee. Bracket 419 also includes tube 427 which is welded at the intersection of plates 421 and 423. Bracket 419 can also be implemented with two "L" channel sections with tube 427 in the corner of one of those sections.

Figure 12:
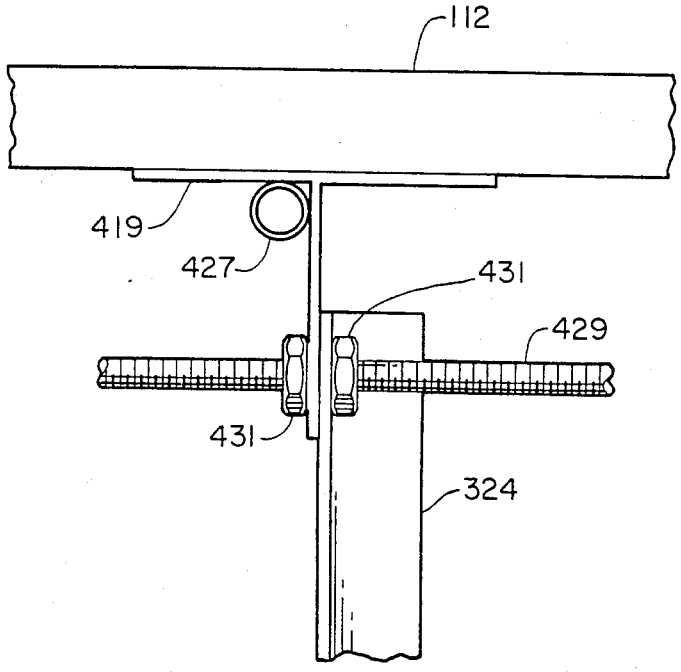
FIG. 12 shows another embodiment for connection of the upper end of a stabilizer arm to the same frame member as the support arms of an adjacent support unit.

FIG. 12 shows an embodiment where stabilizer arm 324 is connected (not shown) to frame 112 by means of bracket 419. Additionally, bracket 419 and stabilizer arm 324 are fastened to threaded rod 429 of FIG. 10 by means of nuts 431 compressing stabilizer arm 324 together with bracket 419.

FIGS. *6a* and *6b* each show a different view of the clamp half 401 of the present invention. The clamp half 401 is made from a single piece of a selected material substantially in the shape of the letter "C" with the concave interior portion 403 being substantially parabolic and dimensioned to be greater than the thickness of the flange of the bracket and the mobile home support frame 112 which are to be clamped together. The concave region is offset vertically from the center of the "C" such that the top lobe 402 of clamp half 401 has a smaller vertical dimension than its bottom lobe 404. Additionally, clamp half 401 includes a hole 405 formed through bottom lobe 404 substantially parallel to the major parabolic axis of the concave interior portion 403.

Figure 7:
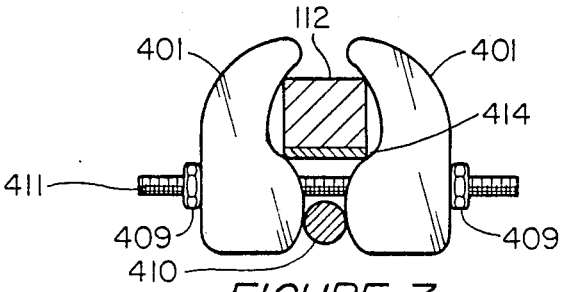
FIG. 7 illustrates the clamping action of the clamps as shown in FIG. 6.

FIG. 7 is a simplified drawing to demonstrate the use of clamp half 401. The items to be clamped together are mobile home frame member 112 and flange 414 of bracket 412. This is accomplished by placing double threaded rod 411 with its threaded ends extending outward beyond the sides of member 112 and flange 414. A clamp 401 is then placed on each of the threaded ends of rod 411 with its concave portion 403 toward member 112 and flange 414 and the ends of rod 411 extending through holes 405. Nuts 409 are then threaded onto both ends of rod 411 and tightened. To prevent the bending of threaded rod 411 as nuts 409 are tightened a spacer 410 is inserted between clamp halves 401 on the opposite side of rod 411 from frame member 112 and flange 414. Spacer 410 could also be rod 429 when the stabilizer arm 122 is being clamped to the same frame member as the support arms of the adjacent support unit and a rod 429 is used as in FIG. 10. In most installations, at least two of these clamp arrangements will be utilized with each mounting bracket. With bracket 412, both flanges 414 and 416 would be clamped to member 112, and with bracket 419, plate 421 on either side of plate 423 would be clamped to member 124.

Bracket 419 of FIG. 9 can be used in any of the support configurations shown in FIGS. 1, 3 or 4. If the selected support configuration is non-interlocking, as in FIGS. 1 and 3, tube 427 of bracket 419 of each complete support unit should be axially aligned to obtain maximum advantage from this bracket design.

Figure 11:
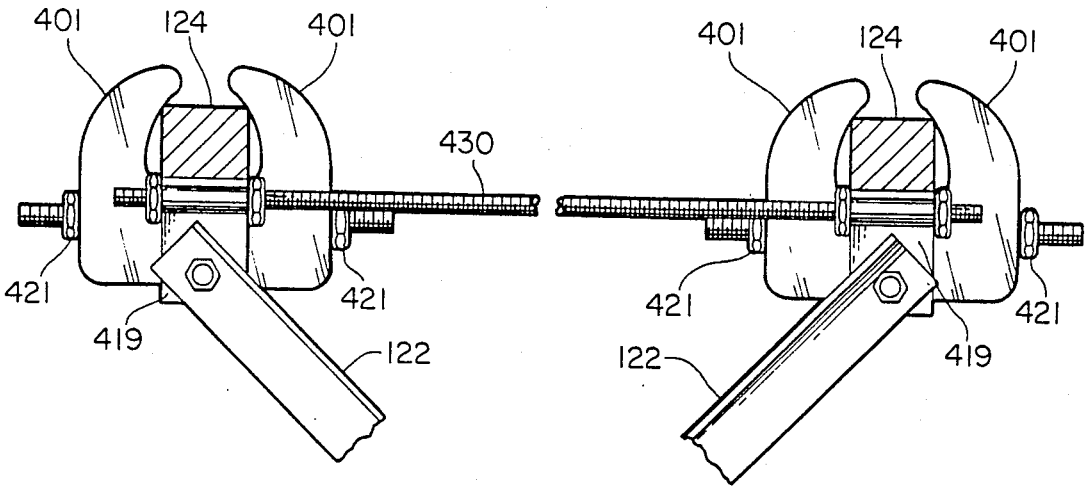
FIG. 11 shows the stabilizer arms of the device of either FIGS. 1 or 3 fastened to a support beam of the mobile home utilizing the stabilizer arm brackets of FIG. 9 and the clamps of FIGS. 6*a* and 6*b*.

FIG. 11 shows a simplified cut-away view of the suggested installation of brackets 419 bolted to the end of stabilizer arms 122 by means of hole 425 in plate 423 of mobile home frame members 124 by means of clamps 401 as discussed in relation to FIG. 7. To provide additional strength to the installation and the mobile home frame members, a double threaded rod 430 is passed through tubes 427 on each of the brackets 419. Rod 430 is then fastened in place by means of a pair of nuts 421 on its threaded ends with one nut 421 at each end of each tube 427.

High strength is achieved by each configuration in the preferred embodiments. The load capacity of a compression member such as a support arm in the present invention is well-known to vary with the ratio Kl/r, where K is a constant (equal to 1 for the preferred angle of 45°), l is the length of the arm, and r is the radius of gyration, which depends on sectional properties of the arms. For example, for a 24" arm of the preferred 2"×3"×¼" steel, r=0.391 and Kl/r=61.38. The correspondingly allowable load per area is 17.3 Ksi, which yields 16.2 Kps for the preferred arm configuration. A more complete discussion of this mode of analysis may be found in the text *Structural Steel Design* by Joseph Bowles (New York McGraw-Hill, 1980), Chapter 6.

The preferred embodiments are installed after the mobile home is mounted on piers in the usual way. Thus, they provide a strong stabilizing support for transportable buildings to protect them and their contents against damage which may be caused by them slipping off the piers. Adjustment can easily be made for variations in the height of buildings, and several embodiments may be constructed from the same basic components. Additionally, these embodiments minimize the number of pieces necessary to construct each support and require that only about six different lengths of arms be stocked for all possible installations.

I claim:

1. A stabilizing support for the transportable building, the underside of the building having a plurality of parallel beams arranged to be supported above the ground, said support comprising:

a base disposed for resting on the ground, said base having a single planar vertically extending flange;

a pair of rigid support arms of substantially equal length, each of the support arms extending diagonally upward from the base for attachment to a first beam, each of the support arms having a lower end affixed to the vertically extending flange of the base and an upper end disposed to be connected to said first beam with both support arms in a vertical plane;

a single rigid stabilizing arm extending diagonally upward from the base to a second beam, having one end affixed to the vertically extending flange of the base and the other end disposed to be connected to said second beam; and bracket means for engaging at least one of the upper end of the stabilizing arm and the upper end of each of the first pair of support arms to the first and second beams, respectively; and clamp means including:

a pair of clamp halves each having a top lobe and a bottom lobe, the top lobe having a smaller vertical dimension than the bottom lobe, between said top and bottom lobes there is defined a parabolic concave inner surface wherein the shortest distance between the ends of the concave inner surface is greater than the combined thickness of the portion of the bracket means and the first and second beams to be clamped, each of said clamp halves also defining a hole extending through the bottom lobe substantially parallel to the major parabolic axis of the concave inner surface;

double threaded bolt means of a selected length to span the width of the beam to which the bracket means is being clamped and to pass through the hole in each of the clamp halves and to extend beyond the convex outer surface of same; and a pair of nuts screwed onto opposite ends of the double threaded bolt means for tightening the clamp halves around the portions of the bracket means and being clamped together.

2. A stabilizing support for transportable buildings as in claim 1 wherein said bracket means includes:

support arm bracket means for engaging the upper end of each support arm to the frame; and stabilizing arm bracket means for engaging the stabilizing arm to the frame.

3. A stabilizing support for transportable buildings as in claim 2 wherein said support arm bracket means includes:

a U-channel portion having two sides substantially parallel to each other and a third side substantially perpendicular to said two parallel sides, each of said parallel sides defining a hole therethrough in substantial alignment with the hole in the opposite parallel side, said third side defining a hole therethrough substantially equidistant from said two parallel sides, the hole in the third side being disposed to permit attachment of the upper end of one of the support arms to the U-channel portion; and a plate portion affixed substantially perpendicular to each of the sides of the U-channel portion and extending beyond at least said parallel sides of the U-channel portion to form flanges, said plate portion being disposed to be parallel and juxtaposed with the selected beam with the flanges being disposed for clamping to the selected beam by means of the clamp means.

4. A stabilizing support for transportable buildings as in claim 3 further comprising:

threaded rod means passing axially through the holes in each of the parallel sides of each of the support arm bracket means affixed to the pair of support arms; and a pair of nuts on each end of the threaded rod means adjacent the outer surface of each of the parallel sides of each of the support arm bracket means for maintaining spacing between said support arm brackets;

said rod means also passing between the bottom lobe on the side of the bolt means away from the top lobe of each of the clamp halves disposed to attach the support arm bracket means to the beam providing a fulcrum for creating closure of the clamp means.

5. A stabilizing support for transportable buildings as in claim 2, wherein said stabilizing arm bracket means includes:

a first planar plate being disposed to be parallel and juxtaposed with the selected beam for clamping thereto by means of the clamp means;

a second planar plate affixed substantially perpendicularly to the first plate to form a tee, said second plate defining a hole therethrough being disposed to permit attachment of the upper end of the stabilizing arm means to the second plate; and cylindrical tube means affixed at the intersection of said first and second plates with the longitudinal axis of the tube means substantially parallel to that intersection.

6. A stabilizing support for transportable buildings as in claim 5, further comprising:

threaded rod means passing axially through the cylindrical tube means of each of the stabilizing arm bracket means; and a pair of nuts on each end of the threaded rod means, one of said pair of nuts adjacent each end of the cylindrical tube means of the stabilizing arm bracket means for maintaining spacing between adjacent stabilizing arm bracket means.

* * * * *